United States Patent [19]

Siebold

[11] Patent Number: 4,627,266

[45] Date of Patent: Dec. 9, 1986

[54] SPINDLE PRESS WITH CONTINUOUSLY ROTATING FLYWHEEL

[76] Inventor: Heinz Siebold, Heidedyk 4, D-4150 Krefeld, Fed. Rep. of Germany

[21] Appl. No.: 621,497

[22] Filed: Jun. 18, 1984

[30] Foreign Application Priority Data

Jun. 18, 1983 [DE] Fed. Rep. of Germany ..... 3322064

[51] Int. Cl.[4] ..... B21J 7/46

[52] U.S. Cl. ..... 72/444; 72/30; 72/26; 192/103 C; 192/143; 192/0.077

[58] Field of Search ..... 72/444, 454, 21, 26, 72/30, 1; 192/103 L, 143, 144, 0.077, 85 AA, 101, 102, 66

[56] References Cited

U.S. PATENT DOCUMENTS 2,177,447 10/1939 Bragg ..... 192/103 C 3,177,993 4/1965 Riehl ..... 192/103 C 3,842,652 10/1974 Yonezawa et al. ..... 72/454

FOREIGN PATENT DOCUMENTS 3102665 12/1982 Fed. Rep. of Germany .

*Primary Examiner*—Daniel C. Crane

*Assistant Examiner*—David B. Jones

[57] ABSTRACT

A spindle press of the type in which an inertial mass controls the clutch connecting a continuously rotatable flywheel with the spindle and is effective when the ram is retarded to decouple the spindle from the flywheel. The control unit is provided directly on the ram and the mass is arranged so as to be movable at least with its principal component of movement in the working direction of displacement of the ram, thereby excluding from significance any distortion of the spindle and the spindle nut drive between the ram and the flywheel.

8 Claims, 7 Drawing Figures

SPINDLE PRESS WITH CONTINUOUSLY ROTATING FLYWHEEL

FIELD OF THE INVENTION

My present invention relates to a spindle press having a continuously rotating flywheel and, more particularly, to flywheel type presses in which between the drive and a workpiece a threaded connection is provided which causes advance of the tool member on a ram along a spindle.

BACKGROUND OF THE INVENTION

It is known to provide a spindle press with a continuously driven and unidirectionally rotating flywheel which can be coupled to the spindle by a fluid-pressure-operated clutch so that the ram or tool of the press is urged against a workpiece. Upon decoupling of the flywheel from the spindle, the ram can, also via appropriate fluid-operated means, be withdrawn back into its starting position.

To establish the point at which the clutch is decoupled or disengaged, it is known to provide a valve which operates by inertia, i.e. continues to move when a rotating element is brought to standstill at the end of the press stroke. This continued movement is transformed into the opening of a valve to interrupt the energization of the clutch and decouple the flywheel from the spindle.

While some earlier spindle presses utilized pneumatic fluid operators, a hydraulic system is described in the German Open Application DE-OS 31 02 665 which utilizes an inertial valve operator in the manner described. In that system the inertial valve operator is a control mass which is provided at the head of the spindle and has freedom of rotating movement about the axis of rotation of the spindle.

This control mass is not, however, readily accessible and, while the spindle press in which it is used represents a significant advance over the art described in that application, the ability to compensate for varying desired operating conditions and workpiece deformations is not any easier than was the case with still earlier systems.

Consequently, although the earlier press of these applications is highly advantageous in many respects, it is capable of further improvement, particularly with respect to the ability of modify press operations to suit various conditions which may arise. One of the most important points at which improvement is desirable is in the elimination of the effect of elastic deformation in the spindle-to-spindle nut drive upon the termination of the clutch actuation, a phenomenon which is especially pronounced when comparatively slender spindles are provided.

OBJECTS OF THE INVENTION

It is, therefore, the principal object of the present invention to provide an improved spindle press which, while retaining many of the advantages of the press described in the aforementioned copending application, nevertheless is free from certain disadvantages thereof and affords greater capacity for adjustment to various operating conditions.

Another object of this invention is to provide an improved spindle press which allows greater precision in control of the clutch, which makes the inertial mass or the control member more easily accessible for adjustment and setting for different operating conditions, and which in general improves upon the versatility of the press by allowing a wider range of adjustability of the switching characteristics of the press to be utilized.

SUMMARY OF THE INVENTION

These objects and others which will become more apparent hereinafter are attained, in accordance with the present invention, by coupling the control mass with the ram and disposing this control mass and the valve operated thereby in such operative connection that the valve is controlled at least in part by a component of movement of the control mass parallel to the linear displacement of the ram in the operating direction so that the inertial mass continues to move with at least a major component of its movement in this direction when the ram is halted at the end of the press stroke.

More specifically, the control mass is provided in or on the ram and is so mounted as to have at least a major component of its mobility in the working direction of the ram but relative to the latter against a restoring force which is effective after the control or inertial mass has ended its movement relative to the ram to restore this control mass to an original position vis-a-vis the ram.

According to a preferred and best mode embodiment of the invention, the control valve which, upon actuation by the mass, deenergizes the clutch, is provided with an actuating rod operatively connected to the mass and extending and displaceable in the working direction, i.e. parallel to the movement of the ram in its working stroke.

The invention is based upon my discovery that the valve, control mass and the means connecting the mass to the valve can be provided directly on the ram and thus the operation of the valve can be free from any effect of deformability of the ram or the spindle or spindle cover mechanism which drives the latter. This significantly increases the precision of control. Because the significant elements for this control are provided directly on the ram, they are easily accessible and replacement of the parts or adjustment of them is possible without difficulty to ensure a wide range of responses of the control device to press operation.

The invention can be embodied in various ways with the preferred and best mode embodiment being characterized by its exceptional simplicity and reliability because the valve element connected with the ram is formed as a housing in which the actuating rod is movably mounted and within which both the control mass and the valve member are mounted. In this relatively simple arrangement, the control mass can be mounted direction on the rod.

Naturally, this embodiment has its most simple construction when the rod extends in the direction of movement of the ram for the working stroke.

In another embodiment of the invention, however, a lever is fulcrummed or pivotally mounted about an axis orthogonal to the direction of movement of the ram during its working stroke and the actuating rod for the valve is articulated to the lever. In all embodiments, of course the accessibility of the parts is ensured so that the parts can be adjusted as required to establish the desired response of the range of responses.

It has been found to be advantageous, moreover, to provide a spring force of the restoring spring against which the control mass acts, to that it is adjustable and appropriate means can be provided for this purpose. When a lever arrangement is utilized in the manner described, moreover, the relative lengths of the affected lever arms can be adjusted.

According to another feature of the invention, the actuating rod can extend from the housing toward the tool and into the path of the head of this rod an adjustable abutment or stop can be provided for the displacement-dependent actuation of the clutch. This abutment or stop can be adjustably mounted on the press frame. In this embodiment, the spindle press can be controlled not only in response to the work performed on the workpiece but also in response to the displacement of the tool.

When displacement-dependent actuation of the clutch is desired, the actuating rod for the valve, which projects from the housing in the direction of the tool, can be provided with a rod pivotally connected to a lever arm, the rock being tiltable about a pivot in or on a housing with a free lever arm of the rocker carrying the control mass. In the latter case the position of the control mass along the second lever arm can be adjusted.

In all of the embodiments described, including those with or without levers or rise, the kinematic relationship between the rod and the control mass should be such that the movement in the linkage can occur without blocking or without significant restraint.

Furthermore, it will be noted that the abutment used for displacement control can also be adjusted so that the displacement control of the friction clutch can be varied for different operating conditions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
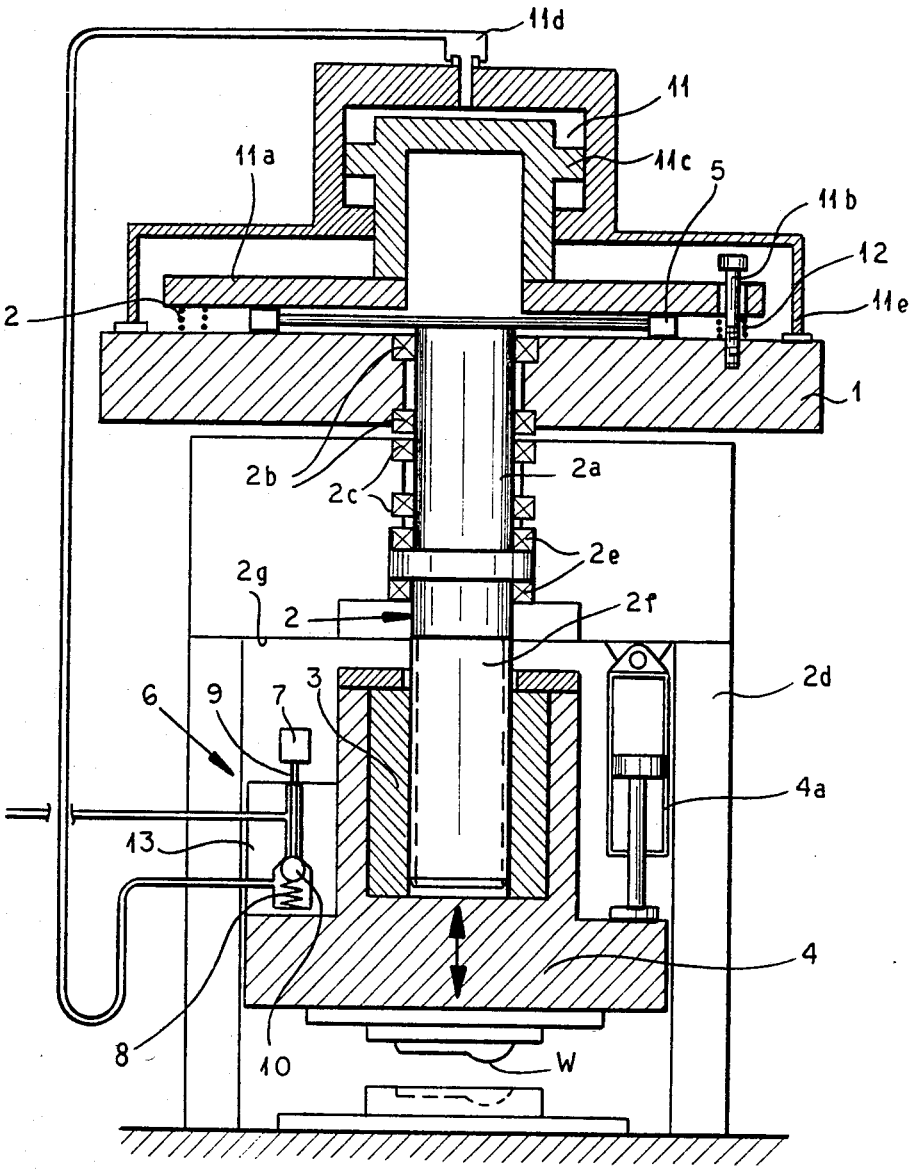
FIG. 1 is a vertical section of a spindle press in accordance with the inventions.

The spindle press shown in FIG. 1 in highly diagrammatic form comprises a continuously rotating flywheel 1, the drive of which has not been illustrated but which may be an electric motor connected to the flywheel by a belt or gear train. The flywheel 1 is rotatable relative to and around the spindle 2 which has a shank **2*a* journaled within the flywheel 1 by bearings 2*b* which other bearings 2*c* journal the spindle on a press frame 2*d*. Thrust bearings 2*e* hold the spindle so that it cannot move axially on the frame 2*d***.

Below the bearings described, the spindle can be provided with a threaded portion **2*f*, threadedly engaged in a spindle nut 3 which is nonrotatably received in a ram provided with a stamping, forging or embossing tool W. The plurality of hydraulic or pneumatic cylinders 4*a* may connect the ram directly with the headpiece 2*g* of the frame to return the ram to its upper position shown when the spindle 2 is decoupled from the flywheel 1**, the spindle being free to rotate in the opposite sense from that of the flywheel during this return stroke of the ram.

To couple the flywheel 1 with the spindle 2, I provide a friction clutch 5 which is hydraulically actuated by a hydraulic system which has not been illustrated in detail and may be of the type described in the aforementioned application. The clutch 5 may include plates connected to the flywheel 1 and interfitted with plates connected to a pressing disc **11*a* which is biased away from the flywheel 1 by coil springs 12 angularly equispaced around the periphery of the disc 11*a* which is coupled to the flywheel for rotation therewith by the bolts 11*b*** only one of which has been illustrated, but which are surrounded by the coil springs.

The disc can be pressed downwardly by a piston **11*c* upon pressurization of a compartment 11 by hydraulic fluid under pressure supplied to the chamber 11 via a head 11*d* permitting the assembly 11*a* through 11*c* to rotate with the flywheel and the housing 11*e*** enclosing the clutch.

The clutch is thus actuated to frictionally couple the spindle with the flywheel, thereby driving the tool W and the ram 4, downwardly.

A control unit 6 for the friction clutch relieves the pressure in compartment 11, mechanically displaces the valve member to the end and thereby decouples the flywheel from the spindle to terminate the descent of the ram. The ram can then be raised in the manner previously mentioned.

The hydraulic actuating network for the clutch can include a pressure generating unit such as a pump, a starting or triggering unit such as a valve and a pressure accumulator as described in the aforementioned application.

The control device 6 includes an inertial element, namely the control mass 7 which, according to the invention, is free to move in the direction of displacement of the ram and which, upon retardation or immobilization of the ram, continues to move in the working direction to displace an actuating rod 9 against the effect of a restoring spring 8 to shift the valve member 10 and unblock the valve which can be located in a housing 13 shown diagrammatically and provided directly on the ram. When the valve 10 is operated by this inertial action, the pressure in compartment 11 is relieved and the springs 12 open the clutch.

The control mass 7 is, as noted, mounted on or in the ram and is carried by a part thereof.

Figure 2:
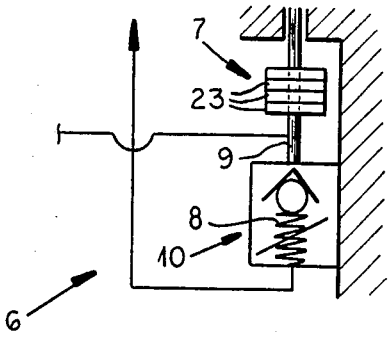
FIGS. 2–5 are diagrams illustrating various kinetic relationships according to the invention between the control or inertial masses and the valve for relieving the pressure of a friction clutch.
Figure 3:
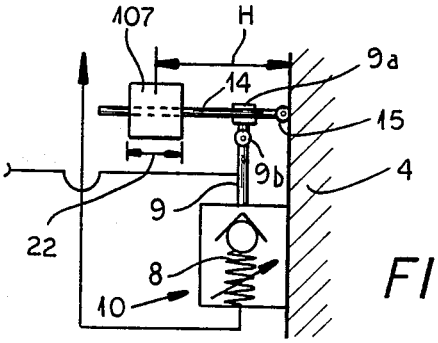
Figure 4:
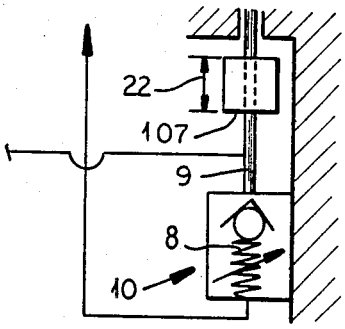
Figure 5:
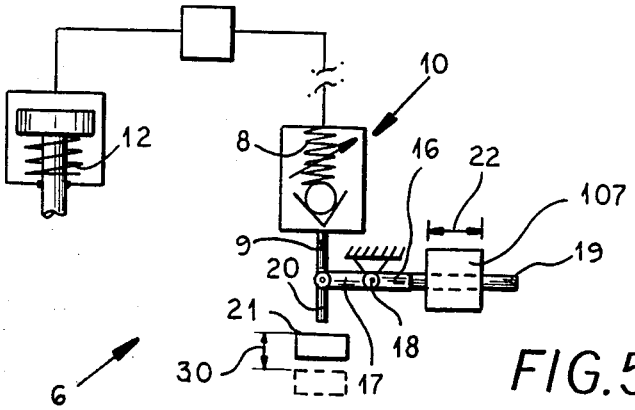
Figure 6:
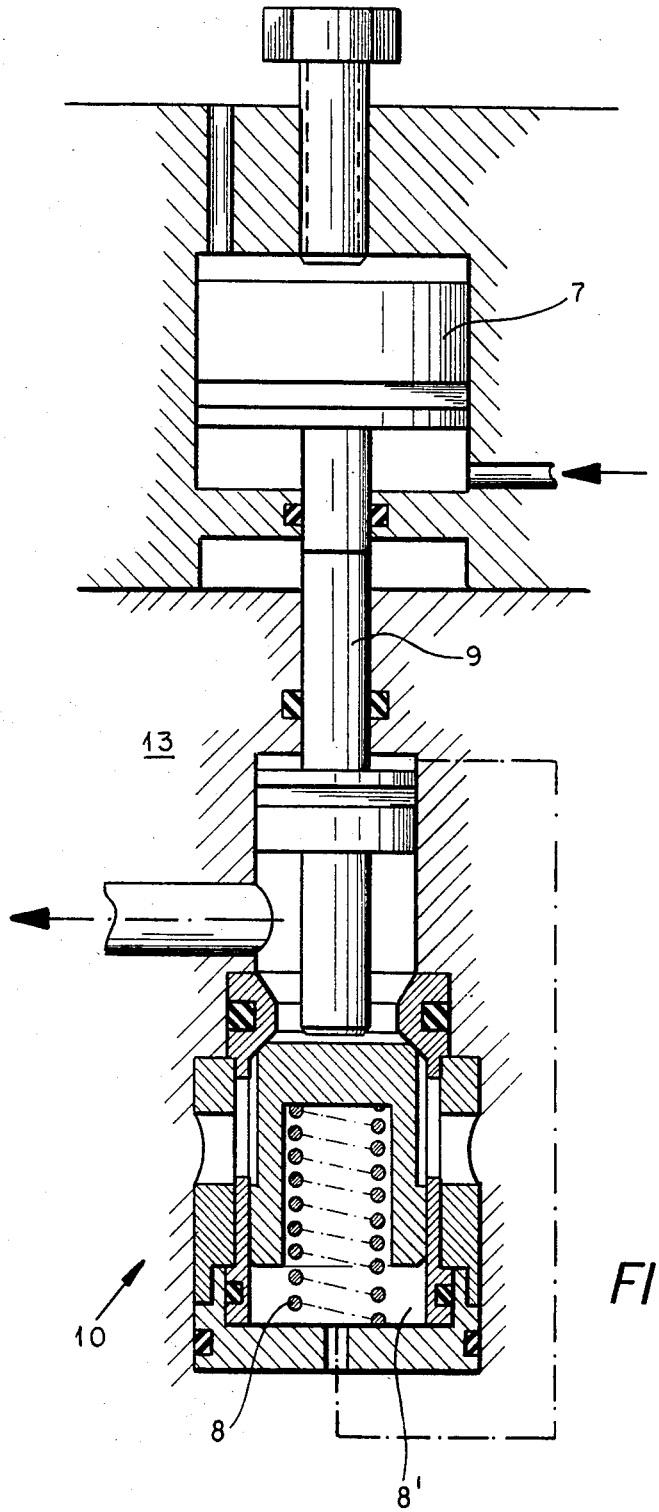
FIG. 6 is a detail view in a vertical section showing the control arrangement of FIG. 1.
Figure 7:
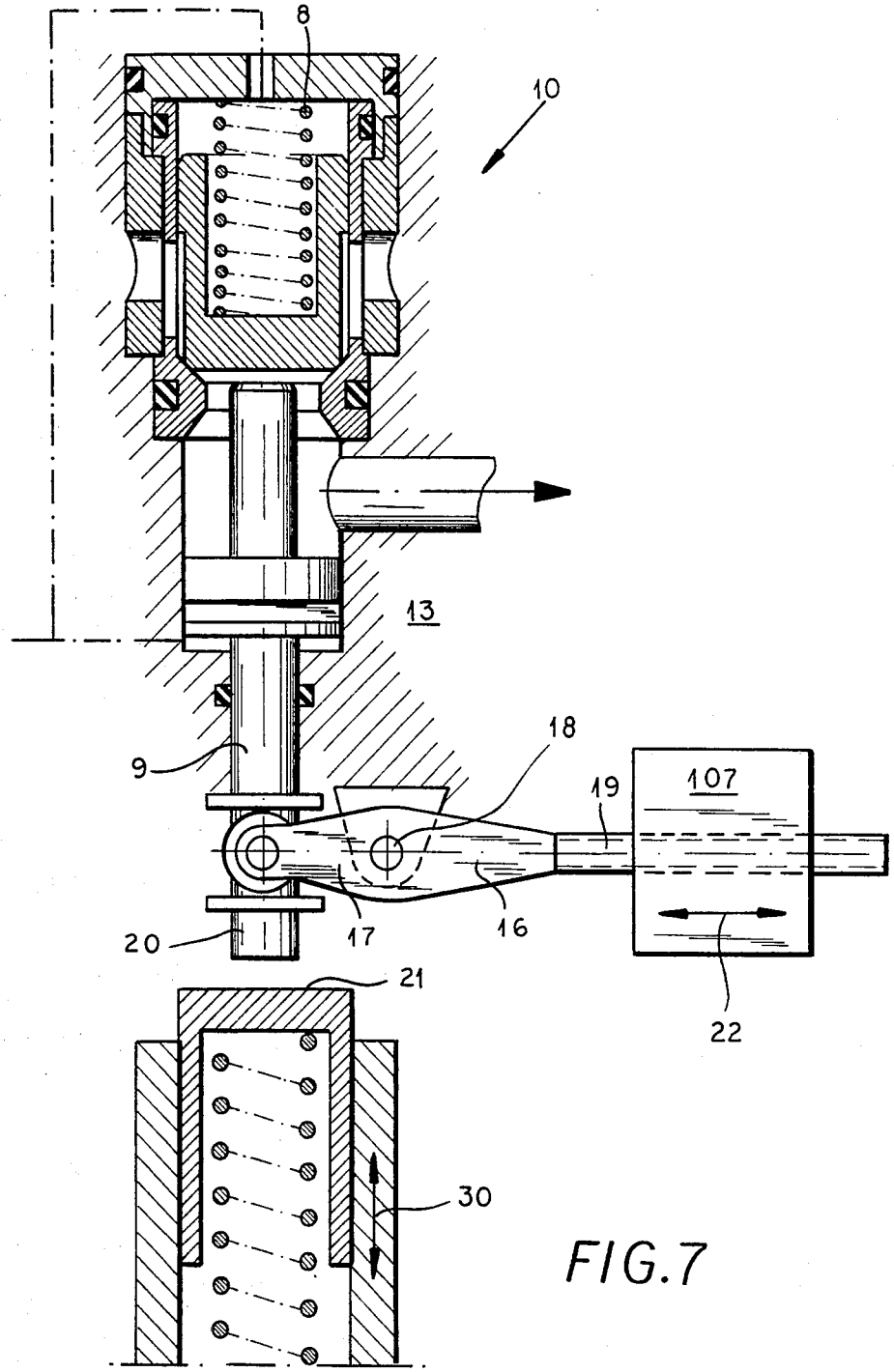
FIG. 7 is a view similar to FIG. 6 but relating to the embodiment of FIG. 5.

In the embodiments of FIGS. 1, 2, 4 and 6, the control mass mobility is exclusively in the ram-displacement direction and in the embodiments of FIGS. 3, 5 and 7, the control mass 107 is displaceable with at least its principal component of displacement inertially in this direction. In all of the embodiments the actuating rod 9 for the valve extends in the direction of working displacement of the ram 4 and is movable relative to the latter.

In all of the embodiments, moreover, the ram 4 is provided with a housing 13 in which the rod 9 is displaceable and which includes the valve 10.

The control mass 7 can also be located within the housing 13 as has been illustrated in FIG. 6.

In the embodiments of FIGS. 1, 2, 4 and 6 the control mass 7 is mounted directly upon the actuating rod 9.

However, in FIGS. 3, 5 and 7 I have shown an embodiment in which a lever mechanism is provided as a force or motion transmission between the control mass 107 and the actuating rod.

More specifically, in FIG. 3 the control mass 7, which is adjustably shiftable in the direction represented by the arrow 22 to vary its position with respect to the fulcrum 15, is mounted on one end of a lever whose other end is pivotally connected at 15 to the ram 4. The lever 14 is articulated to the actuating rod 9 of the schematically illustrated valve in which an arrow represents the adjustability of the force of the spring 8. The articulation is formed by a swivel head 9*a* which can pivot at 9*b* and can slide along the lever 14.

In the embodiments of FIGS. 5 and 7, however, the lever is formed by a rocker 16, one arm 17 which is pivotally connected to the actuating rod 9 which is extended at its head 20 in the direction of the tool from the housing 13 (not seen in this figure). The control mass 107 is mounted on the other lever arm 19 and can be shifted along the latter in the direction of the arrow 22 by rotating the internally threaded mass 107 and the externally threaded lever arm 19. the lever is fulcrummed between these arms at its pivot 18.

In the path of the head 20 of the rod 9, an abutment or stub 21 can be provided for the displacement-controlled deactivation of the friction clutch 5.

The means for adjusting the position of this abutment has been represented diagrammatically at 30 in FIGS. 5 and 7. Hence the displacement control response of the clutch can be adjusted in dependence upon varying operating conditions and deformation characteristics of the workpiece.

The effective mass of the weight 107 can be varied by replacing the mass or adding weights to it. The effectiveness of the spring 8 can be varied as shown by the arrows therethrough and the effective lever arms H, for example, can be varied to suit the operating conditions and the desired response. From FIG. 6 it will also be apparent that the force of the spring 8 can be adjusted by providing a pneumatic cushion at 8' below a seat of this spring. In the preferred state, the restoring spring 8 is an adjustable pneumatic spring.

From FIG. 2 it will be apparent that the control mass 7 and indeed the control masses of all of the other embodiments can be assembled from a stack of movable or replaceable discs 23 with a number of discs, the sizes of the discs and the material from which the discs are constituted, being the determinants of the mass and its inertial effect.

I claim:

1. A spindle press comprising:

a press frame;

a spindle journaled in said frame and having a threaded portion;

a spindle nut threadedly engaging said threaded portion of said spindle and displaceable parallel to an axis thereof upon rotation of said spindle;

a ram forming a tool and connected to said nut for displacement thereby in a pressing direction upon rotation of said spindle in one sense;

a continuously rotating flywheel journaled on said frame;

a fluid-operated clutch actuatable to couple said flywheel with said spindle for rotating said in said sense;

a control unit including a control mass on said arm movable with at least its principal component of movement in said direction for deactivating said clutch upon retardation of the movement of said ram in said direction, and means applying a restoring force to said mass relative to said ram to return said mass to an original position after inertial displacement of said mass relative to said ram in said direction, said control unit including a valve connected to said clutch and having an actuating rod extending in said direction and movable in said direction, said mass being operatively connected to said rod; and means varying said restoring force.

2. The spindle press defined in claim 1 wherein said unit comprises a housing on and connected to said ram and receiving said valve and said mass and in which said rod is movable, said mass being mounted directly on said rod.

3. The spindle press defined in claim 1 wherein said mass is connected to said rod by a lever swingably mounted on said ram for pivotal movement about an axis orthogonal to said direction, said lever being coupled to said rod.

4. The spindle press defined in claim 3, further comprising means for adjusting the effective lever arm between said mass and said pivot.

5. The spindle press defined in claim 1 wherein said means for adjusting said restoring force includes a restoring spring resisting displacement of said rod.

6. The spindle press defined in claim 1 wherein said rod has a head and extends in said direction, further comprising an adjustable stub engageable with said head for displacement control of said valve.

7. The spindle press defined in claim 3 wherein said rod has a head and extends in said direction, further comprising an adjustable stub engageable with said head for displacement control of said valve.

8. The spindle press defined in claim 6, further comprising a rocker having two lever arms pivotally connected to said rod at one lever arm of said rocker and having another lever arm of said rocker provided with said mass.

* * * * *